United States Patent [19]

Gerhard

[11] 4,412,626

[45] * Nov. 1, 1983

[54] FREIGHT CONTAINER WITH MEANS FOR LOCKING THE TENSIONING RINGS

[75] Inventor: Helmut Gerhard, Weitefeld, Fed. Rep. of Germany

[73] Assignee: Gerhard KG, Weitefeld, Fed. Rep. of Germany

[ * ] Notice: The portion of the term of this patent subsequent to Dec. 29, 1998, has been disclaimed.

[21] Appl. No.: 301,135

[22] Filed: Sep. 11, 1981

[30] Foreign Application Priority Data

Sep. 12, 1980 [DE] Fed. Rep. of Germany ..... 3034512

[51] Int. Cl.[3] ..... B65D 88/06; B65D 88/12; B65D 90/00

[52] U.S. Cl. ..... 220/1.5; 220/5 A; 220/71

[58] Field of Search ..... 220/1.5, DIG. 9, 5 A, 220/71

[56] References Cited

U.S. PATENT DOCUMENTS 2,020,256 11/1935 Copeman ..... 220/DIG. 9

4,307,812 12/1981 Gerhard ..... 220/1.5

*Primary Examiner*—William Price
*Assistant Examiner*—David Voorhees
*Attorney, Agent, or Firm*—Barnes & Thornburg

[57] ABSTRACT

A freight container includes a cylindrical tank disposed within an outer frame. The tank is connected to the corner regions of the frame by means of eight saddle pieces which have curved borders welded to tensioning rings surrounding the tank near the ends thereof. Each tensioning ring is composed in the peripheral direction of the tank of two sections clamped together by tensioning screws and locked in both axial directions of the tank by a plurality of sheet metal pieces welded to the tank shell on both sides of each tensioning ring. The tank may be detached from the frame by loosening the tensioning screws whereupon the tensioning rings may be raised over the sheet metal pieces in axially moving the frame relatively to the tank. In assembling the freight container, the metal pieces are welded to the tank in the final manufacturing step after the tank and the frame have been positioned relatively to each other with the required dimensional accuracy.

19 Claims, 8 Drawing Figures

FIG.7
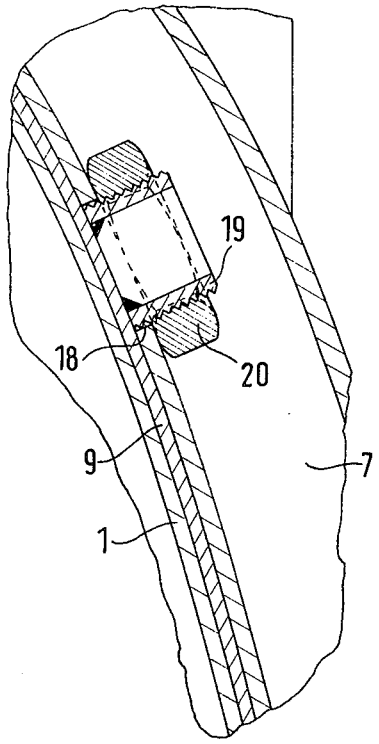
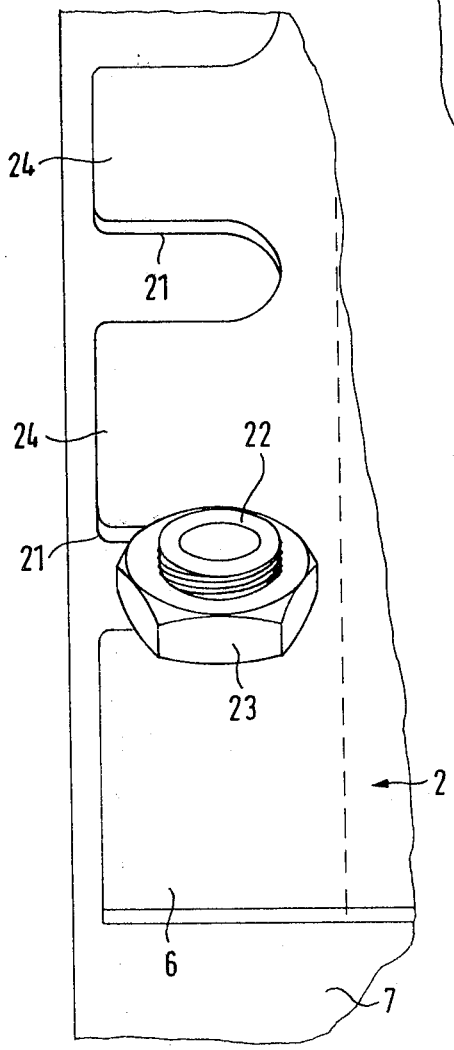
FIG.8

FREIGHT CONTAINER WITH MEANS FOR LOCKING THE TENSIONING RINGS

BACKGROUND OF THE INVENTION

This invention relates to a freight container for transporting fluids.

German Offenlegungsschrift No. 2,828,349 discloses a freight container in which a tank for receiving the fluids is connected to an outer frame by bowl-shaped saddle pieces which have borders curved according to the tank profile and welded to a pair of tensioning rings surrounding the tank at locations near the two ends thereof. Saddle pieces of this type are excellently suited to guide the forces occurring on the tank immediately into the corners of the frame which, in accordance with the pertinent standards, are those portions at which forces can and must be transmitted to and from the exterior. The borders of the saddle pieces engaging the tank cause a good distribution of the forces via the tensioning rings over the tank periphery, thereby largely avoiding tension peaks.

In order to detach the tank from the frame in the known arangement, the tensioning rings which form the connection between the saddle pieces and the tank, each consists of two flange rings screwed together at their mutually facing flanges, one of the flange rings being welded to the tank shell and the other being welded to the saddle pieces.

Since any screw connection permits basically only a punctual transmission of force, the advantage of a uniform force distribution over the tank periphery would be lost to a certain degree if only two or few screws were employed in the known arrangement to obtain a detachable embodiment. If it is attempted to overcome this problem by a higher number of screws, the labor required in assembly and disassembly becomes considerable. In addition, screw connections disposed within the region of the saddle pieces are comparatively difficult to access. Finally, screw connections are often exposed to an increased danger of corrosion than for instance properly worked welds.

It is an object of the present invention to overcome the disadvantages occurring in prior art freight containers, more specifically to provide a freight container in which the tank and the frame are detachably interconnected. It is another object of this invention to achieve such detachable connection between the tank and the frame of a freight container by means which are as simple and inexpensive with respect to labor and material as possible, and in which an undisturbed transmission of forces between the tank and the frame corner regions is achieved.

BRIEF DESCRIPTION OF THE INVENTION

The freight container of this invention comprises (a) an outer frame, (b) a substantially cylindrical tank, (c) a pair of tensioning rings surrounding the tank near the two ends thereof, each ring being composed in the peripheral direction of the tank of at least two sections, (d) means for interconnecting the sections of each ring to tension the same about the tank, (e) metal pieces welded to the tank for locking each ring in both axial directions of the tank, and (f) saddle pieces connected to the frame at corner regions thereof, each saddle piece having a border portion welded to a respective ring.

The metal pieces for locking the tensioning rings in the axial direction provide a substantial welding seam length to ensure a safe locking of the rings to the tank. Since the rings are subdivided in the peripheral direction, they may be raised and moved over the welded locking metal pieces for disassembly, after the sections of the rings have been disconnected. The tensioning of the rings relative to the tank shell is not only of significance for locking the tank relatively to the frame but also assists the uniform distribution of the forces transmitted from the saddle pieces to the tank shell over the entire periphery of the tank. At the same time, the arrangement of the invention allows large tolerances between the frame and the tank during assembly, so that the rings may be freely shifted to compensate for existing tolerances in length until the locking metal pieces are finally positioned by tacking and welding.

In the freight container according to German Offenlegungsschrift No. 2 828 349 referred to above, the rings are themselves welded to the tank by two girth welds each, and there has been some difficulty in applying these welds with high accuracy. On the other hand, once the rings are welded to the tank, tolerances in length between the tank and the outer frame can no longer be compensated.

In a preferred embodiment of the invention, each metal piece abuts the respective tensioning ring along a straight edge to provide a sufficient length of abutment between the tensioning ring and the locking metal piece. In another preferred embodiment, each metal piece engages a complementary cut-out provided in the tensioning ring to achieve an additional locking in the peripheral direction without additional expensive measures.

In a further preferred embodiment, each metal piece is undercut at that portion of its border at which it abuts the tensioning ring, so that the metal pieces may be welded along their entire border without interfering the abutment to the tensioning ring.

In further preferred embodiments, the metal pieces are staggered in the peripheral direction on both sides of each tensioning ring or are disposed near both ends of each saddle piece on both sides of each tensioning ring, to improve the transmission of forces between the tank and the outer frame.

In a further preferred embodiment, a flat intermediate ring is disposed under each tensioning ring and welded to the tank, wherein the metal pieces are welded to the intermediate ring, and the intermediate ring has a width greater than the sum of the widths of the tensioning ring and twice the axial dimension of one metal piece. An even more uniform distribution of forces over the periphery of the tank shell is thereby achieved, while maintaining the advantage of compensating for differences in length between the frame and the tank until the final assembly.

The advantage of a practically complete thermal insulation of the tank with respect to the frame is obtained in accordance with a further preferred embodiment by disposing a layer of permanent-elastic, fatigue-resistant, and thermally insulating material under each tensioning ring.

In further preferred embodiments, the tensioning rings have their radial height reduced to the minimum allowable cross-section in the region of the maximum horizontal and/or vertical extension of the tank, and the joints between the tensioning ring sections are disposed in regions between the maximum horizontal and maximum vertical extensions of the tank. These measures are advantageous for maximum exploitation of the available container profile, specifically in case the widths of the container is limited to eight feet in accordance with the ISO standard.

Further advantageous embodiments will become apparent from the following description.

BRIEF DESCRIPTION OF DRAWINGS

FIG. 7 is a partial axial section of the freight conainer, showing an additional locking measure; and FIG. 8 is a side view of a portion of the freight container showing a further locking measure.

DETAILED DESCRIPTION OF PREFERRED EMBODIMENTS

Figure 1:
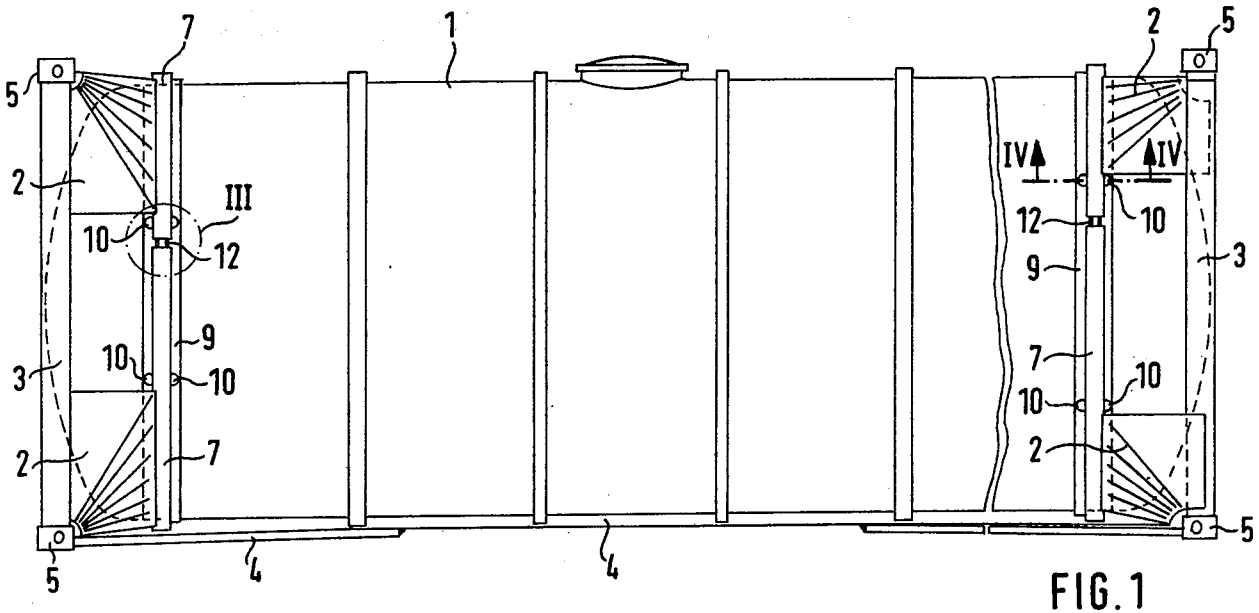
FIG. 1 shows a side view of a freight container.
Figure 2:
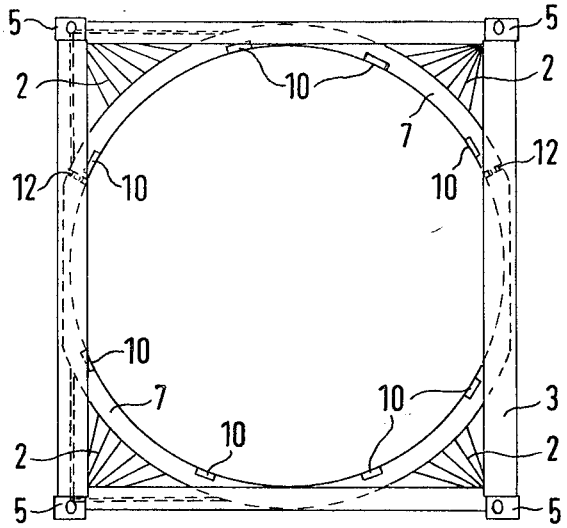
FIG. 2 is an end view of the freight container of claim 1.

According to FIGS. 1 and 2, the freight container comprises a tank 1 connected through a total of eight saddle pieces 2 to two end frame portions 3. In the embodiment shown, the two end frame portions 3 are additionally connected to each other and to the tank 1 by a bottom structure 4. One corner fitting 5, which corresponds to the pertinent standards, is provided at each of the eight corners of the frame formed by the frame portions 3 (and by the bottom structure 4). The corner fittings 5 are the only parts which can transmit forces between the tank 1 and a support (not shown) such as a transport vehicle or a hoist. These forces are introduced from the tank 1 via the saddle pieces 2 directly into the frame particularly in the lower corner regions thereof. The saddle pieces 2 may have the shape disclosed in German Offenlegungsschrift No. 28 28 349.

Figure 3:
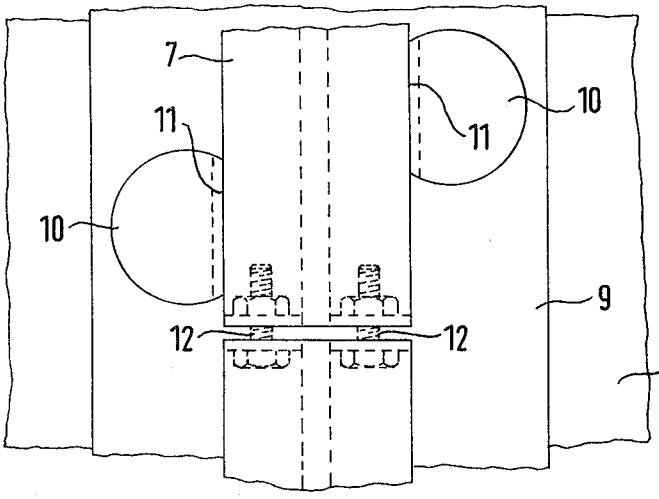
FIG. 3 shows the detail indicated by III in FIG. 1 on a larger scase.
Figure 4:
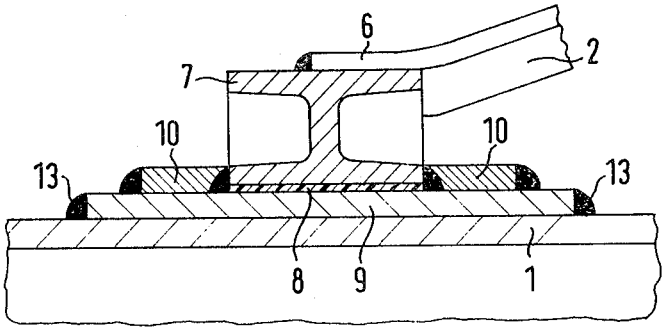
FIG. 4 is an enlarged partial section along the line IV—IV in FIG. 1.
Figure 5:
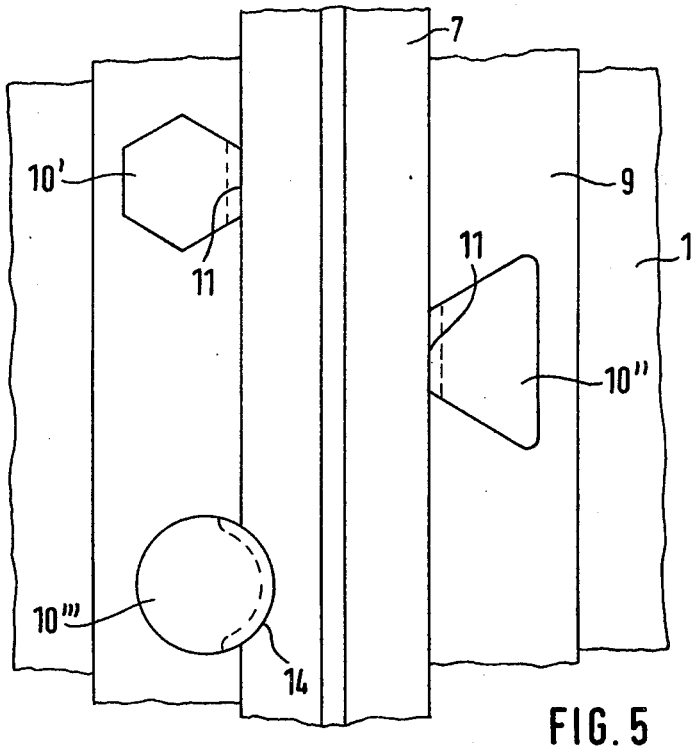
FIG. 5 is a representation similar to FIG. 3 showing alternatives of locking metal pieces and their cooperation with the tensioning ring.
Figure 6:
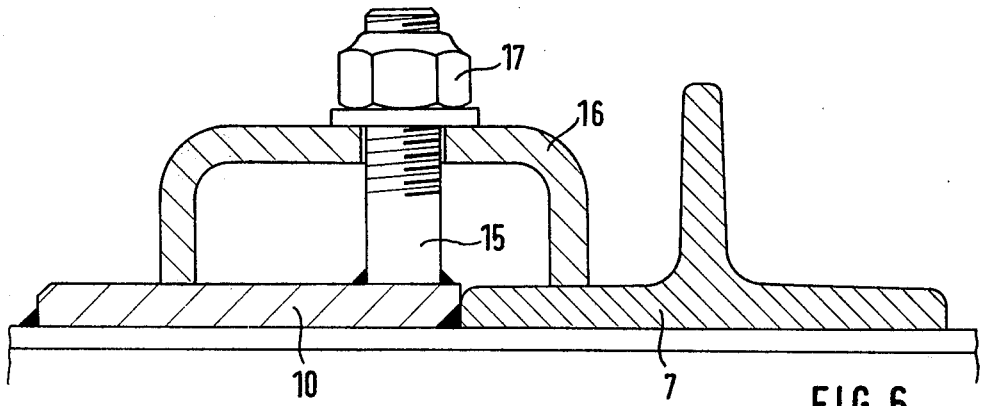
FIG. 6 is a representation similar to FIG. 4 showing an additional tensioning means.

According to FIG. 4, the border 6 of each bowl-shaped saddle piece 2, which is curved in correspondence with the tank profile, is welded to the outer flange of a tensioning ring 7 which, in the embodiment selected, has an I-profile. Alternatively, a tensioning ring having an upright or lying profile, a simple T-profile (as shown in FIG. 6) or a flat profile (according to FIG. 8) may be used. The tensioning ring 7 lies on an intermediate ring 9 with a thermally insulating layer 8 interposed, the intermediate ring 9 being in turn welded to the shell of the tank 1. In the axial direction, the tensioning ring 7 is locked by sheet metal pieces 10 which, according to FIG. 3, abut with a straight edge 11 at the lower flange of the tensioning ring 7 and are welded along the rest of their edge to the intermediate ring 9. In the embodiment shown in FIG. 3, the sheet metal pieces 10 are shaped as segments of a circle to avoid tension peaks possibly occurring at right or acute angles. Alternatively, polygonal (obtuse-angled) sheet metal pieces may be used with one side abutting the tensioning ring 7. FIG. 5 shows such hexagonal and trapezoidal sheet metal pieces 10′ and 10″ respectively.

As is shown in FIG. 2, any two locking sheet metal pieces 10 (on both sides in the axial direction) are disposed in the region of each corner of every saddle piece 2. Alternatively, it may be useful, to distribute several locking sheet metal pieces 10 over the periphery of the tensioning rings 7 and dispose the sheet metal pieces 10 in a staggered manner on both sides of the tensioning ring, as indicated in FIGS. 3 and 5.

In contrast to the sheet metal pieces 10, 10′ and 10″ shown in FIGS. 3 and 5, each of which has a straight edge abutting to the lower flange of the tensioning ring 7, the metal piece 10‴ shown in the lower left portion of FIG. 5 is shaped completely circular and partly engages a complementarily shaped cut-out 11 in the lower flange of the tensioning ring 7. Thus, the tensioning ring 7 is locked not only in the axial direction of the tank but also in the peripheral direction.

It is furthermore understood from FIG. 2 that the tensioning rings 7 are flattened in the region of the maximum horizontal extension of the tank to enable maximum utilization of the available profile for the tank volume. Similar flattenings may be of significance also in the region of the maximum vertical tank extension, depending on the cross-sectional shape of the tank and on the profile of the frame.

As is further shown in FIGS. 1 and 2, the tensioning rings 7 are composed of at least two sections in the peripheral directions, the joints between these sections being disposed in regions lying above and thus outside the maximum horizontal extension of the tank. According to FIG. 3, the tensioning ring sections are interconnected by two or more clamp screws 12 and tensioned on the tank. Instead of, or in addition to, such clamps screws, shrink pieces may be used for forcibly connecting the tensioning ring sections.

In assembling the freight container shown in the drawings, the two intermediate rings 9 are first welded to the corresponding portions of the tank shell, each by two closed girth welds 13. The pressure-proof and fatigue-safe insulating layer 8 is disposed on each intermediate ring 9, and the tensioning ring composed of its two sections is placed thereon without tensioning to be shiftable at first. The saddle pieces 2 connected to the frame are now welded to the outer surfaces of the tensioning ring. The shiftability of the tensioning rings 7 with respect to the intermediate ring 9, thus to the tank 1, serves to compensate shrinkage which may occur up to the final assembly. Upon the final tensioning of the tensioning ring sections by means of the clamp screws 2 in accordance with the given dimensions and tolerances, the locking sheet metal pieces are fixed to the intermediate ring 9 on both axial sides of the tensioning ring 7 by overlap welds. To this end, the sheet metal pieces 10 are undercut at that portion of their edges which engage the tensioning ring 7 or the cut-outs 14, so that the welds do not hinder a proper abutment in these edge regions.

For disassembly, it is only required to loosen the clamp screws 12 whereupon the tensioning rings 7 may be lifted and moved over the locking sheet metal pieces 10 which have an accordingly low height. The reassembly is done correspondingly.

FIG. 7 shows a measure for additionally tensioning the tensioning ring 7, which consists of a simple T-profile. A threaded bolt 15 is welded on the locking sheet metal piece 10 and carries a clamping bracket 16 the two ends of which bear on the sheet metal piece 10 or on the lower flange of the tensioning ring 7. The clamping bracket 16 is tensioned by means of a nut 17 screwed on the threaded bolt 15.

In the embodiment of FIG. 7, the lower flange of the tensioning ring 7 has bores 18. Upon assembly of the tensioning rings 7 on the intermediate ring 9 and possible locking in the axial direction by means of sheet metal pieces (not shown in FIG. 7), threaded sleeves 19 are inserted into the bores 18 and interiorially welded to the intermediate ring 9. The tensioning ring 7 is thus secured also against rotation in the peripheral direction. A nut 20 screwed on the threaded sleeve 19 serves for additional locking and securing in case the tensioning screws should come loose.

A further securing against rotation between the tensioning ring and a saddle piece 2 is shown in FIG. 8. There, the border of the saddle piece 2 welded to the tensioning ring 7 has notches between the remaining fringe-like fingers 24 as are known per se from German Offenlegungsschrift No. 28 28 349. Upon assembly, threaded sleeves 22 are passed through individual ones of these notches 21 and welded to the tensioning ring 7 by an interior weld. A nut 23 screwed on the threaded sleeve 22 again serves for locking. The doubling of the sheet metal thickness in this region simultaneously serves to reinforce the notches.

I claim:

1. A freight container for fluids, comprising (a) an outer frame, (b) a substantially cylindrical tank, (c) a pair of tensioning rings surrounding said tank near both ends thereof, each ring being composed in the peripheral direction of said tank of at least two sections, (d) means for interconnecting said sections of each said ring to tension the same about said tank, (e) metal pieces welded to said tank for locking each said ring in both axial directions of said tank, and (f) saddle pieces connected to said frame at corner regions thereof, each saddle piece having a border portion welded to a respective one of said rings.

2. The container of claim 1, wherein each said metal piece abuts the respective tensioning ring along a straight edge.

3. The container of claim 1, wherein each said metal piece engages a complementary cut-out provided in the respective tensioning ring.

4. The container of claim 3, wherein the shape of said metal pieces is selected from circular, hexagonal and trapezoidal shapes.

5. The container of claim 1, wherein each said metal piece is undercut at that portion of its border at which it abuts the respective tensioning ring, for allowing a non-projecting weld.

6. The container of claim 1, wherein said metal pieces are staggered in the peripheral direction on both sides of each said tensioning ring.

7. The container of claim 1, wherein said metal pieces are disposed near both ends of each said saddle piece on both sides of each said tensioning ring.

8. The container of claim 1, wherein said means for interconnecting said ring sections comprise tensioning screws.

9. The container of claim 1, including a flat intermediate ring disposed under each of said tensioning rings and welded to said tank, said metal pieces being welded to said intermediate ring.

10. The container of claim 9, wherein said intermediate ring has a width exceeding the sum of the width of said tensioning ring and twice the axial dimension of one said metal piece.

11. The container of claim 1, comprising a layer of permanent-elastic, fatigue-resistant, and thermally insulating material disposed under each said tensioning ring.

12. The container of claim 1, including a threaded bolt mounted on each said metal piece, and a clamping bracket mounted on said bolt for locking a respective one of said tensioning rings.

13. The container of claim 1, including threaded sleeves welded to said tank and extending through bores provided in said tensioning rings, and nuts mounted on said sleeves for locking said tensioning rings.

14. The container of claim 10, including threaded sleeves welded to said intermediate ring and extending through bores provided in said tensioning rings, and nuts mounted on said sleeves for locking said tensioning rings.

15. The container of claim 1, including threaded sleeves welded to said tensioning rings and engaging notches provided in said borders of said saddle pieces, and nuts mounted on said sleeves for locking said saddle pieces to said tensioning rings.

16. The container of claim 1, wherein each said tensioning ring has its radial height reduced to the minimum crosssection required for effective tensioning in the region of the maximum horizontal extension of said tank.

17. The container of claim 1, wherein said tensioning ring has its radial height reduced to the minimum crossection required for effective tensioning in the region of the maximum vertical extension of said tank.

18. The container of claim 1, wherein joints between said tensioning ring sections are disposed in regions lying between the maximum horizontal extension and the maximum vertical extension of said tank.

19. The container of claim 1, wherein the profile of said tensioning rings is selected from T-, I-, U- and flat profiles.

* * * * *